US005782369A

United States Patent [19]

Tansey

[11] Patent Number: 5,782,369

[45] Date of Patent: Jul. 21, 1998

[54] LINERLESS CLOSURE FOR CONTAINER

[76] Inventor: Charles Martin Tansey, 29 Laycock Road, Penshurst, N.S.W. 2222, Australia

[21] Appl. No.: 602,754

[22] PCT Filed: Aug. 19, 1994

[86] PCT No.: PCT/AU94/00486

§ 371 Date: Feb. 15, 1996

§ 102(e) Date: Feb. 15, 1996

[87] PCT Pub. No.: WO95/05321

PCT Pub. Date: Feb. 23, 1995

[30] Foreign Application Priority Data

Aug. 19, 1993 [AU] Australia ..... PM0705
Mar. 25, 1994 [AU] Australia ..... PM4717

[51] Int. Cl.[6] ..... B65D 41/34; B65D 53/00

[52] U.S. Cl. ..... 215/344; 215/345; 215/DIG. 1; 215/252; 215/331

[58] Field of Search ..... 215/44, 45, 252, 215/343, 344, DIG. 1, 331, 330, 329, 341, 346, 345

[56] References Cited

U.S. PATENT DOCUMENTS

| | | | |
|---|---|---|---|
| 3,067,900 | 12/1962 | Kessler | 215/344 X |
| 3,203,571 | 8/1965 | Plunkett | 215/344 |
| 4,540,102 | 9/1985 | Wiedmer | 215/DIG. 1 X |
| 4,598,835 | 7/1986 | Brownbill | 215/DIG. 1 X |
| 4,739,893 | 4/1988 | Zumbuhl | 215/DIG. 1 X |
| 5,004,112 | 4/1991 | McBride | 215/252 |
| 5,050,753 | 9/1991 | Trump et al. | 215/252 |
| 5,090,788 | 2/1992 | Ingram et al. | 215/252 |
| 5,197,621 | 3/1993 | Bartl et al. | 215/331 |

FOREIGN PATENT DOCUMENTS

| | | | |
|---|---|---|---|
| 649118 | 10/1992 | Australia | 215/252 |
| 460813 | 12/1991 | European Pat. Off. | 215/344 |
| 2021530 | 12/1979 | United Kingdom | 215/DIG. 1 |

*Primary Examiner*—Allan N. Shoap
*Assistant Examiner*—Nathan Newhouse
*Attorney, Agent, or Firm*—Lowe, Price, LeBlanc & Becker

[57] ABSTRACT

A closure for a container having a two portion sealing rib projecting downwardly form the underside of the top. The first portion of the rib being contiguous with the top and the second portion being frusto-conical and contiguous with the end of the first portion and extending radially inwardly to terminate in a circular free edge. The upper surface of the second portion has an engagement means comprising a continuous annular ridge which engages with the underside of the top of the closure which in turn has a continuous annular ridge positioned inwardly and adjacent the first portion of the sealing rib. A closure for a carbonated liquid container having a sealing means which has attached thereto an abutment which will firmly engage with the thread on a neck of container if the closure is over-torqued thereby preventing missiling of the closure off the container.

13 Claims, 11 Drawing Sheets

LINERLESS CLOSURE FOR CONTAINER

FIELD OF THE INVENTION

This invention relates to closures for sealing the opening of containers. In particular, the invention provides a closure which seals the opening of a screw top container for carbonated liquid such as soft drink, but is also well adapted to seal other containers such as glass or poly(ethylene terephthalate) (PET) containers with contents at, above, or below atmospheric pressure or having gaseous components or requiring an hermetic seal.

Screw top closures have been used for some time to seal various containers. Although many screw tops include a separate sealing gasket within the closure, there is substantial advantage to be had in producing a one-piece closure which will effectively seal the container.

The present invention also relates to closures for carbonated beverage containers which are improved to prevent sudden release of the closure from the container if the closure is over-torqued.

BACKGROUND ART

It is known from the applicant's prior Australian patent specification 627746 to provide a one piece closure for a container having an externally screw threaded neck. Such closures are moulded in one piece from a resilient synthetic plastic material and comprise a top portion and a skirt depending from an underside of the top portion, the skirt having an internal surface with a complementary screw thread to that on the container. The seal between the closure and the container is provided by an annular sealing rib which projects downwardly from the underside of the top portion, the rib includes a first portion contiguous with the top portion and abutting or lying adjacent to the skirt and a second, frusto-conical, portion contiguous with an end of the first portion distal to the top portion and extending radially inwardly to terminate in a circular free edge. The internal diameter of the first portion is sized such that during threaded engagement of the closure with the neck, the second, frusto-conical portion will be engaged by a free end of the container neck and folded back against the inner surface of the first portion of the rib to form a gas-tight seal between at least an outer surface of the neck of the container and the closure.

Such closures have been found to work well on containers which are designed for single use. In such single use containers the dimensions of the neck remain within tight tolerances and the annular contact area between container and rib may be relatively small and still form a good seal between the rib and the neck of the container. When the aforedescribed closures are used on multi-trip or reusable containers, the dimensions of the neck may not be so uniform, due to distortion or chipping of the neck during use. With reusable containers, it is desirable to make the contact area between the neck and the rib larger so that there is a larger zone of sealing between the rib and the neck of the container. This raises a problem, however, because the present inventors have found that as the length of the first portion of the rib increases, the ability of the free end of the first portion to exert radially inward pressure forcing the second portion of the rib into sealing engagement with the neck of the closure decreases. Thus, merely lengthening the first of the rib has been found not to necessarily increase the effective sealing area between the rib and the neck of the container to the extent expected. It has also been determined that merely lengthening the second portion of the rib does also not necessarily increase the effective sealing area between the rib and the neck of the container. The present invention is directed to providing a means of at least ameliorating this problem.

Another problem which has been observed with closures having an integral sealing system or a separate sealing means, such as an annular gasket or a circular pad, is that, if the closure is over-torqued, the threads on the closure may override those on the container. This can allow the closure to be propelled off the container under the pressure exerted by the carbonated contents of the container. This problem is termed "missiling" and typically occurs when a person, often a child, becomes confused as to which direction the closure should be turned to remove it from the container. The closure may then be forced further onto the container than it was designed to be, ie, it may be over-torqued, and missiling may then occur.

DISCLOSURE OF THE PRESENT INVENTION

According to a first aspect of the present invention there is provided a closure for a container having a neck, the closure being moulded in one piece from a resilient synthetic plastic material and comprising a top and a skirt depending from an underside of the top, which skirt has an internal surface with a means for attachment with the neck of the container, and an annular sealing rib projecting downwardly from the underside of the top of the closure, the rib including a first portion having a substantially cylindrical inner surface, the first portion being contiguous with the top and lying adjacent to the skirt and a second, frusto-conical, portion contiguous with an end of the first portion distal to the top, having an upper surface, and extending radially inwardly to terminate in a circular free edge, the first portion having an internal diameter suitable for receiving the external diameter of the neck of the container to which the closure is to be attached such that during attachment of the closure with the neck, the second, frusto-conical, portion of the rib will be engaged by a free end of the neck and folded back against the substantially cylindrical inner surface of the first portion of the rib to form a gas-tight seal between at least an outer surface of the neck of the container and the closure, the closure being characterised in that there is formed on the upper surface of the second portion of the rib and proximate its free edge, engagement means so arranged that during attachment of the closure with the neck, the engagement means engages with the underside of the top.

The engagement means on the upper surface of the second portion of the sealing rib is preferably a spaced apart array of projections or a segmented or a continuous annular ridge.

The engagement means on the upper surface of the second portion of the sealing rib serves to engage with the underside of the top of the closure and to keep the free edge of the sealing rib pinched between the free end of the neck of the container and the underside of the top of the closure. The retention of the free edge of the second portion of the annular sealing rib pinched between the neck of the container and the closure as the closure is tightened down onto the neck is believed to serve to draw the sealing rib more tightly in against the outside surface of the neck of the container. This provides a greater area of sealing between the sealing rib of the closure and the neck of the container than would otherwise be achieved.

In a preferred embodiment of the invention, the underside of the top of the closure is provided with a spaced apart array of projections or a segmented or a continuous annular ridge positioned inwardly and adjacent the first portion of the annular sealing rib. The array of projections or the segmented or continuous annular ridge is so arranged that during attachment of the closure with the neck, the array of projections or the segmented or continuous annular ridge on the underside of the top engages with the upper surface of the second portion of the rib adjacent and outside the array of projections or annular ridge on the second, frusto-conical portion. If desired, a series of projections and/or segmented or continuous ridges may be used on the upper side of the second portion of the sealing rib or on the underside of the top of the closure or both.

In a further embodiment the array of projections and/or segmented or continuous ridges on the underside of the top and the upper side of the second portion of the sealing rib are adapted to interlock as the closure is attached to a container thereby holding the surface of the rib touching the underside of the closure stationary and causing the second portion of the sealing rib to be disposed over a greater area of the underside of the top as well as the outer surface of the neck of the container.

Preferably the first portion and second frusto-conical portion of the sealing rib are of a constant thickness and join at an included angle of at least 90°. More preferably the frusto-conical portion of the rib is of a thickness tapering from a maximum thickness proximal the end of the first portion to a minimum thickness at its circular free edge.

In another embodiment of the invention, a free edge of the depending skirt is joined by a plurality of frangible bridges to a tamper evident band. The band preferably comprises a generally cylindrical body portion and a segmented rib extending inwardly of the body portion and arranged to provide a lip to engage under a retaining flange extending outwardly from the neck of the container below the attachment means. The engaging rib has an upper side facing generally towards the top of the closure and an underside facing generally away from the top. The body portion is with projections or other localised areas of thickening to enhance the longitudinal stiffness of the body portion while still permitting it to expand radially as it is forced over the retaining flange on the container.

The upper side of the engaging rib preferably comprise a first surface contiguous with the body portion of the band, which surface slopes inwardly and downwardly from the top, and a second surface which is positioned radially inwardly from the first surface. The second surface has a slope angle more nearly normal to the longitudinal axis of the closure than the first surface is to that longitudinal axis.

The radially inner surface of the band is preferably provided with an array of radially spaced apart inwardly extending projections positioned between the rib and a free edge of the band. The projections, or some of them, may, if desired, make contact with the underside of the rib across the longitudinal width of the band or they may stop short of the lower free edge of the band. The projections are preferably aligned parallel with the longitudinal axis of the closure but may be inclined to that axis. In a particularly preferred embodiment, the segmented rib has alternate projections disposed beneath the gaps between the rib segments and beneath, most preferably, the mid-points of the underside of the rib segments, said projections abutting the underside of the segments.

In another embodiment, the tamper evident band comprises a generally cylindrical body portion depending from the skirt of the closure via frangible bridges, and a series of hooks, each hook comprising a frusto-conical portion hingably connected to an inner surface of the body portion adjacent an end of the body portion distal the skirt of the closure. Each frusto-conical portion preferably extends inwardly and upwardly to terminate in a free edge. Each frusto-conical portion also has a curvature substantially identical to the curvature of the inner surface of the body portion and is nestable against the inner surface of the body portion whereby on attachment to the container, the free edge of the frusto-conical portion engages under the retaining flange of the container with the frusto-conical portion proximate the hinge coincident with the inner wall of the body portion such that the free edge of the frusto-conical portion is not exposed to tamper.

The neck of the container is preferably externally screw threaded and the radially inner surface of the skirt is preferably formed with a complementary screw thread. It would, however, be possible to form the closure as a crown seal or "snap on" closure by appropriately forming the skirt and the neck of the container. The container closure may also include a closure useful for mounting valves on pumps for controlling discharge from the container.

The thread on the internal surface of the skirt is preferably formed of a series of thread segments arranged, starting from a first thread segment distal to the top, along a helical thread locus. Each of the thread segments, except the first, is preferably formed with two substantially planar end surfaces which are inclined to the axis of the closure and face away from the closure top, i.e. they face in the direction that a mould core used to mould the closure is withdrawn. The first of the thread segments is preferably pointed at its end distal to its one adjacent thread segment to assist in mating the thread on the closure with the complementary thread on the neck of a container.

Preferably the plastics material is high density polyethylene, low density polyethylene, or polypropylene. Where the container is to be used for carbonated beverages or other gas pressurised liquids, the plastics material must have a very low porosity to the gas.

In another aspect the present invention is designed to ameliorate, or in preferred cases prevent, the problem of missiling.

According to this second aspect, the present invention consists in a closure suitable for mounting on a container having an externally screw threaded neck, the closure having a top and a skirt depending from the underside of the top, a complementary screw thread being formed on the internal surface of the skirt, sealing means being formed on the underside of the top or on the skirt for engagement with a neck or a free end of the container and arranged to form a seal therewith when the closure has been screwed onto the container a predetermined amount which adequately seals the container contents, an abutment being formed on an internal surface of the closure and being so placed thereon that it will be positioned adjacent to the start of the thread on the container when the closure has been screwed onto the container the predetermined amount, but will firmly engage with the start of that thread if the closure is screwed onto the container more than the predetermined amount.

In another aspect the present invention consists in a container containing a carbonated beverage to which a closure according to the second aspect of the present invention has been applied.

The abutment may be formed on the underside of the top, on the internal surface of the skirt, or on the sealing means. In a particularly preferred embodiment of the invention, the sealing means comprises an annular sealing rib which projects downwardly from an underside of the top of the closure. The rib including a first portion having a substantially cylindrical inner surface, the first portion being contiguous with the top and lying adjacent the skirt of the closure, and a second, frusto-conical, portion contiguous with an end of the first portion distal to the top and extending radially inwardly to terminate in a circular free edge. The first portion has an internal diameter at least equal to the external diameter of the container, such that during threaded engagement of the closure with the neck, the second, frusto-conical, portion will be engaged by a free end of the neck and folded back against the substantially cylindrical inner surface of the first portion to form a gas-tight seal between at least an outer surface of the neck and the closure. The upper surface of the second portion preferably has formed thereon and proximate its free edge, engagement means which engage with the underside of the top and comprise a spaced apart array of projections or a segmented or a continuous annular ridge. The underside of the top is also preferably provided with a spaced apart array of projections or a segmented or a continuous annular ridge positioned inwardly and adjacent the first portion of the sealing rib. In such a case the abutment is preferably formed on the lower edge of the first portion of the sealing rib. The abutment preferably comprises, in this case, a tab extending downwardly from that edge parallel to the longitudinal axis of the closure.

In the preferred case described above the abutment will be spaced radially inwardly from the skirt by a small amount. It may alternatively be formed on the underside of the top portion in abutment with the skirt, or may be formed on the skirt itself. In any of these cases it may be necessary to position the abutment where a part of the thread of the closure would otherwise have been. In this case, it may be necessary to form a disjunction in the thread on the internal surface of the skirt or to stop that thread short of the abutment.

The correct positioning of the abutment on the closure is crucial to its effective operation in preventing missiling while still allowing the closure to adequately seal carbonated beverage containers. The abutment must be so placed that when the closure is properly applied to the container, the sealing means will be adequately sealed against the container. This is achieved by applying to the closure a predetermined torque during the capping operation, which translates to the closure being applied to the container by a predetermined amount. Typically the torque may be from 10 to 20 in/lb. The second requirement is that the abutment then lies adjacent to the start of the thread on the container, so that further forward rotation of the closure relative to the container will bring the abutment into binding engagement with the thread of the container.

The binding of the abutment against the thread of the container ameliorates the missiling problem in two ways. Firstly the binding raises the torque required to further move the closure forward to a significant extent. This of itself may be sufficient to stop the problem. Secondly, if the person seeking to open the container further persists in rotating the closure despite the binding, the closure will deform with the side of the closure radially opposite the abutment being caused to lift. This releases the seal of the closure against the container and allows venting of the container. This venting removes the pressure that might otherwise cause missiling.

BRIEF DESCRIPTION OF THE DRAWINGS

Hereinafter given by way of example only are preferred embodiments of the invention described with reference to the accompanying drawings, in which.

BEST MODE FOR CARRYING OUT THE INVENTION

A closure for a carbonated beverage container having an externally screw threaded neck and an improved sealing means is generally shown as 10 in FIGS. 1, 3, 4 and 5.

The closure 10 includes a circular top 11 and a depending skirt 12. The inside of the skirt 12 is screw threaded and adapted to be attached to containers commonly made from glass or a plastics material such as poly(ethylene terephthalate) (PET) which has an externally screw threaded neck. The top 11 and skirt 12 are formed integrally from high density polyethylene by injection moulding.

Figure 1:
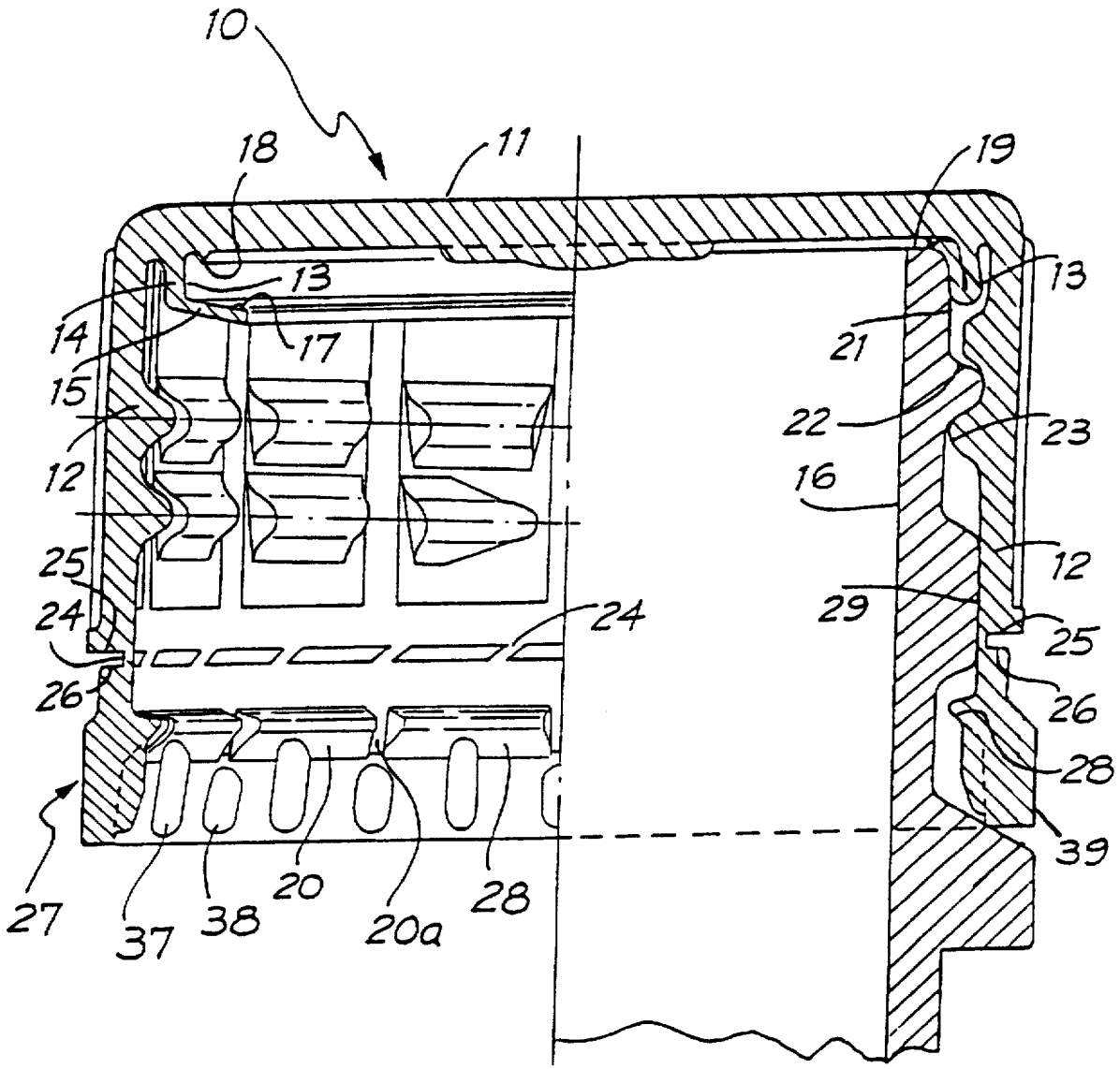
FIG. 1 is a part-diametric view of an embodiment of the closure according to the first aspect of the present invention before engagement with the neck of a container and part-longitudinal cross-sectional view of the closure after sealing engagement with the neck of a container.
Figure 3:
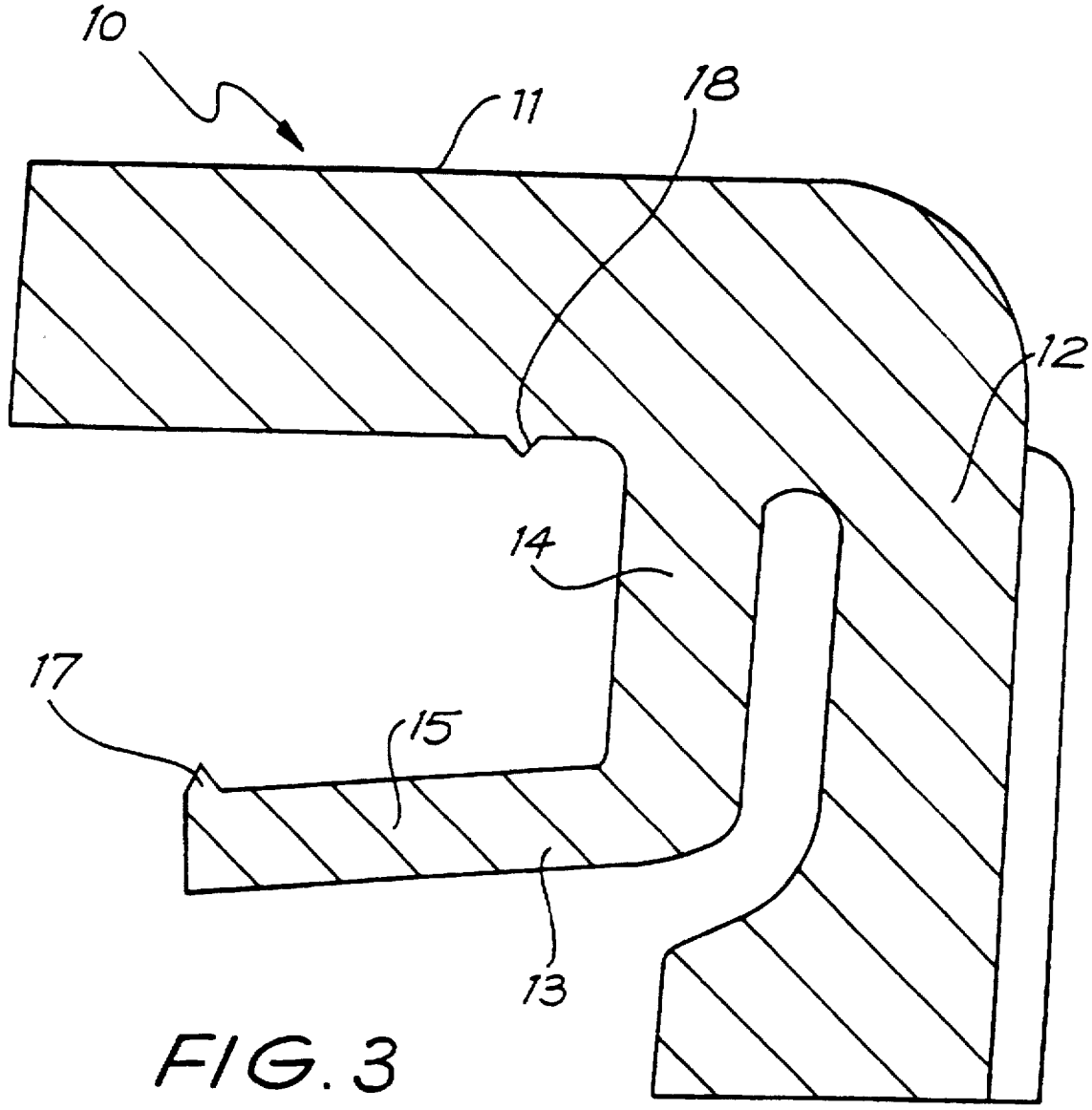
FIG. 3 is an enlarged longitudinal cross-sectional view of a portion of the closure according to the first aspect of the present invention before engagement with the neck of a container.
Figure 4:
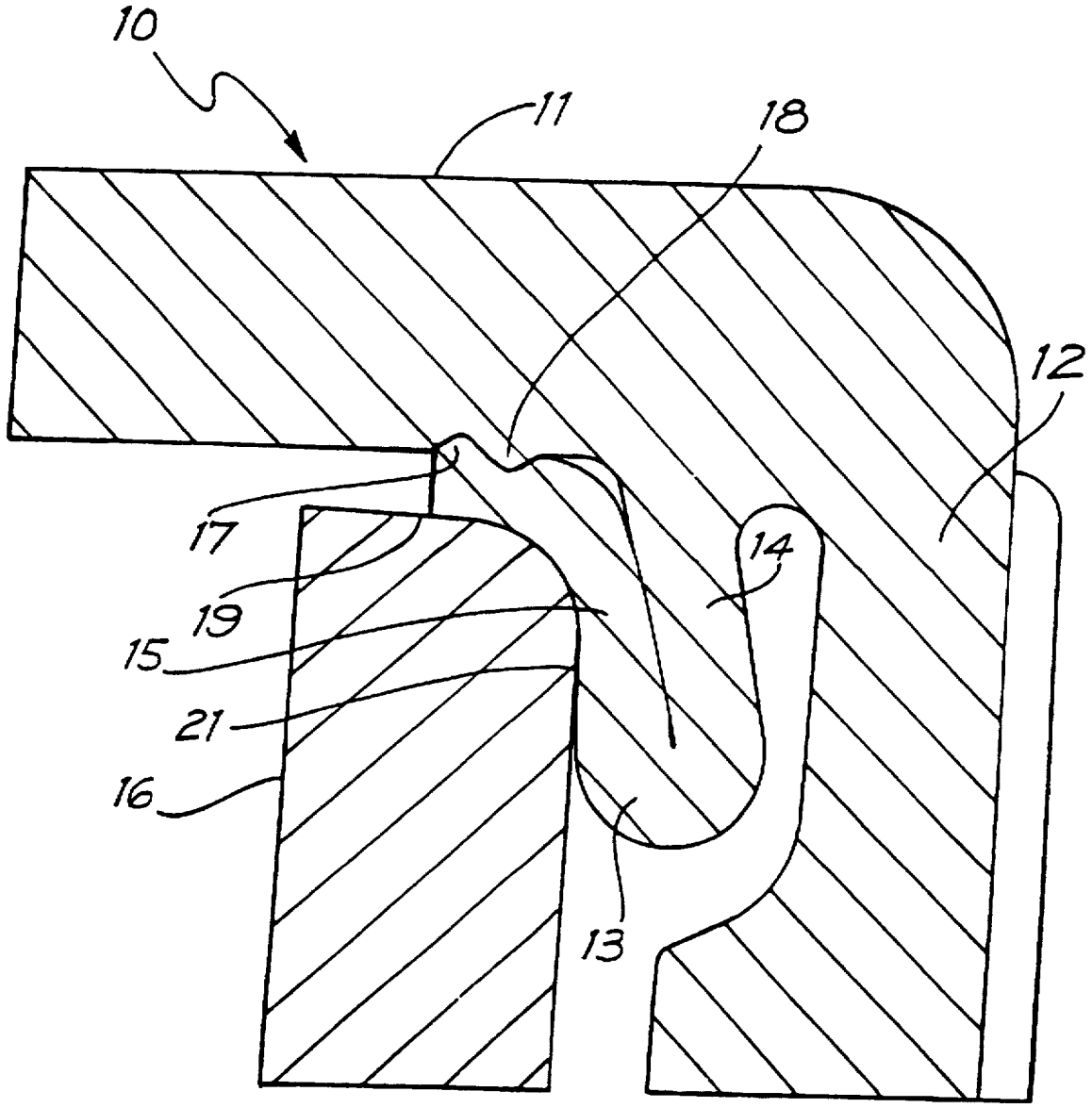
FIG. 4 is an enlarged longitudinal cross-sectional view of a portion of the closure of FIG. 3 sealingly engaged with the neck of a container.
Figure 5:
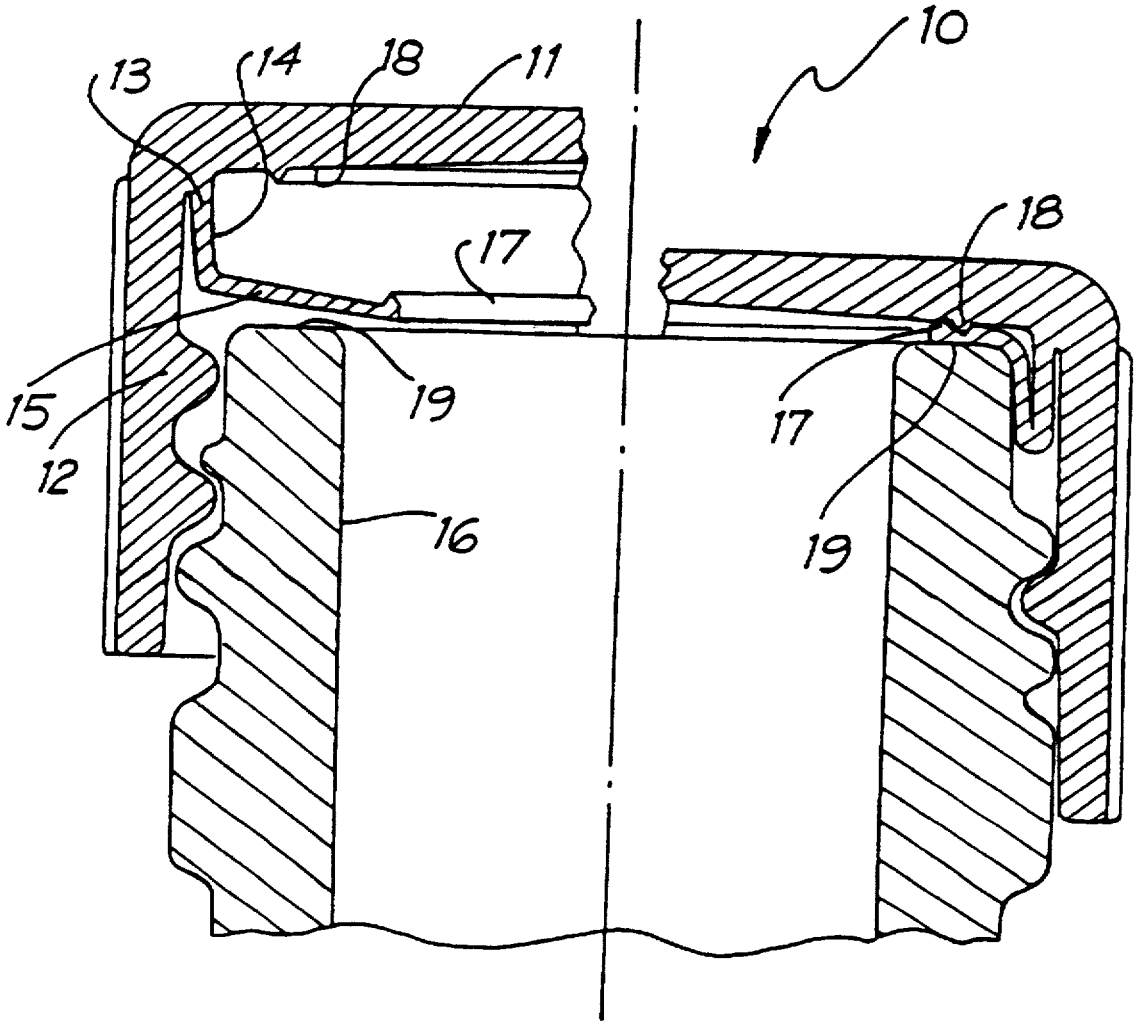
FIG. 5 is a longitudinal cross-sectional view of another embodiment of the closure according to the first aspect of the present invention before engagement with the neck of a container and after sealing engagement with the neck of a container.

The closure 10 includes an annular sealing rib 13 which can extend solely from an underside of the top 11 (as shown in FIGS. 1, 3 and 4) or from the corner formed between the skirt 12 and the top 11 (as shown in FIG. 5). In FIGS. 1, 3 and 4, the annular sealing rib 13 includes a first or root portion 14 spaced apart from the skirt 12 and which extends downwardly, with a second portion 15 which, prior to engagement with the neck of a container 16, is frusto-conical and tapers inwardly and away from the skirt 12. In the embodiment in FIG. 5, the first portion of the sealing rib 13 is adjacent and abuts the skirt 12.

The second portion 15 has formed on its upper surface and proximate its free edge, a continuous annular ridge 17. The underside of the top 11 has formed on its surface inwardly of the first portion 14 of the rib 13 a continuous annular ridge 18.

As the closure 10 is being screwed onto the container 16, the second portion 15 of the rib 13 contacts the end 19 of the container 16 and is caused to fold up against the inner surface of the first portion 14. As the closure 10 is further screwed onto the container 16, contact is made between the underside of the top 11 and the ridge 17 and between the ridge 18 and the upper surface of the second portion 15 of the annular rib 13.

Upon further screwing of the closure 10, the ridge 17 abuts with the ridge 18 thereby ensuring the second portion 15 of the rib 13 is wedged between the end 19 of the container 16 and the top 11 of the closure 10 (as is best depicted in FIG. 4), i.e., the movement attaching the closure 10 tends to pinch the second portion 15 of the rib 13 between the end 19 of the container 16 and the underside of the top also and to "pull" the frusto-conical portion 15 of the annular rib 13 tightly in towards the end 19 of the container 16 to produce a tight seal about the curved edge surface of the container 16 extending from its extreme end annular surface 19 down the side wall 21.

In the embodiment of the invention depicted in FIG. 1, as the closure 10 is attached to the container 16, the screw thread 22 engages the thread 23 on the interior surface of the skirt 12. The closure 10 has frangible bridges 24 extending between the lower edge 25 of the skirt 12 and the upper edge 26 of a tamper evident band 27 forming an annular weak zone. As the closure 10 moves down the neck of the container 16, the rib 28 on the interior surface of the band 27 diametrically expands over a retaining flange 29 on the container 16.

The axis of each frangible bridge 24 is inclined such that when seen in side elevation the upper end of each bridge 24 is inclined to the left relative to its lower end. The bridges 24, therefore, bend as the closure 10 is screwed clockwise onto the container 16. As the rib 28 expands over the flange 29, the lower edge 25 of the skirt 12 and the upper edge 26 of the band 27 have room to flex towards each other whilst still having the bridges 24 therebetween. This stabilises the band 27 and reduces the likelihood of the bridges 24 breaking during application of the closure 10 to the container 16. Once the rib 28 has passed over and engaged under the flange 29, the frangible bridges 24 return to their extended orientation.

The rib 28 is made up of a series of rib segments 20 separated by short breaks 20*a*, however, the rib segments 20 constitute a majority of the circumference of the band 27 and act together as though the rib 28 was substantially continuous. The breaks 20*a* provide circumferential flexibility to the band 27 and allow the rib 28 to pass over the retaining flange 29 when the closure 10 is being applied to the container 16.

Below the rib 28 and on the inside surface of the band 27 is an arrangement of a plurality of inwardly extending projections 37 and 38, each having a long axis generally aligned with the longitudinal axis of the closure 10. The projections 37 and 38 extend radially inwardly from the band 27 sufficiently so as to come into contact with the retaining flange 29 during application of the closure 10 to the container 16 and once the container 16 is capped to lie close to the outer neck surface of the container 16. Each alternate inwardly extending projection 38 is spaced below the brake 20*a* in the rib 28 and is not connected to the rib 28. Each of the remaining extending projections 37 are connected at one end to the centre of a rib portion 20. Each inwardly extending projection 37 and 38 terminates short of the free end of the band 27. The projections 37 and 38 provide vertical strength to the band 27 while allowing radial expansion of the band 27 over the retaining flange 29.

On the outside surface of the band 27 there is provided a number of thickenings 39. Each thickening 39 extends from a region adjacent the level of rib 28 to a region at the free end of the band 27 and forms a corrugated surface on the outside surface of the band 27. The thickenings 39 strengthened the band 27 and thus enhance its vertical stiffness whilst retaining sufficient radial flexibility to allow the band 27 to radially expand over the retaining flange 29 when the closure 10 is being applied to the container 16. The thickenings 39 allow sufficient axial force to be applied to the free end of the closure 10 to successfully eject the closure 10 from a core portion of a mould used in its production.

The outer surfaces of the thickenings 39 present substantially flat lands which lie radially just outside the radial extent of the rest of the closure 10 to allow the land to be mechanically gripped or otherwise contacted without necessarily contacting the skirt 12.

As the closure 10 begins to be unscrewed from the neck of the container 16, the rib 28 detains under the flange 29. As the closure 10 is unscrewed further, the bridges 24 are straightened which serves to concentrate the forces tending to rupture the bridges 24 at the point of attachment at each bridge 24 to the band 27 and the skirt 12.

Figure 2:
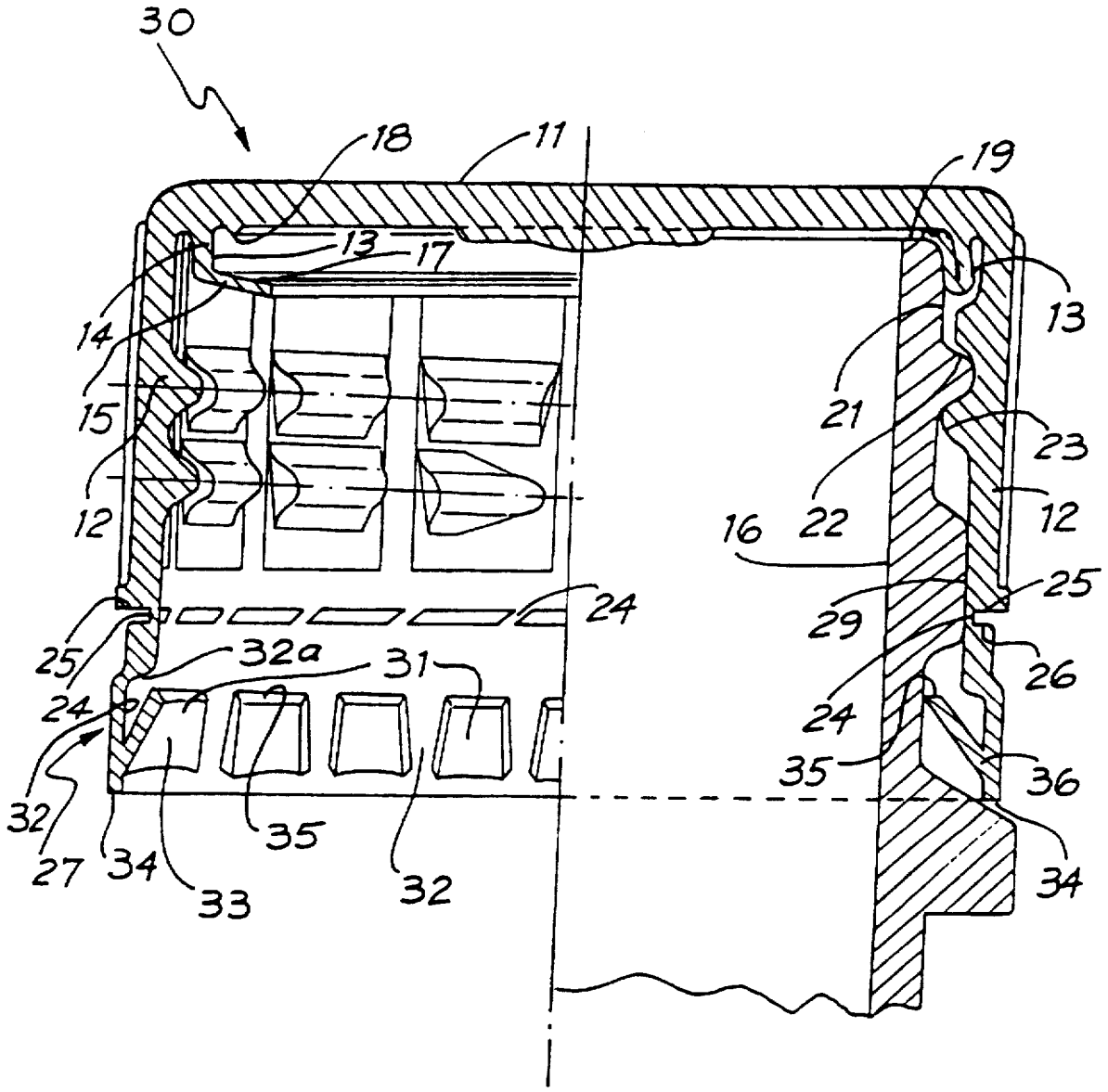
FIG. 2 is a part-diametric view of another embodiment of the closure according to the first aspect of the present invention before engagement with the neck of a container and part-longitudinal cross-sectional view of the closure after sealing engagement with the neck of a container.

In another embodiment of the invention as depicted in FIG. 2, the closure depicted generally as 30 includes a tamper evident band 27 which comprises a series of hooks 31 positioned about the inner surface 32 of the band 27. Each hook 31 consists in a frusto-conical portion 33 connected to the inner surface 32 of the band 27 with a hingable connection 36 positioned adjacent an end 34 of the substantially cylindrical body portion of the tamper evident band 27.

Each frusto-conical portion 33 extends inwardly and upwardly to terminate in a free edge 35.

As the closure 30 depicted in FIG. 2 is attached to a container 16, the frusto-conical portion 33 of each hook 31 folds back in the recess 32a of the inner wall 32 of the band 27 as the inner surface of the frusto-conical portion 33 rides over the retaining flange 29 on the container 16.

Once the free edge 35 has passed over the retaining flange 29, the frusto-conical portion 33 springs inwardly and engages under the flange 29. As the closure 30 begins to be unscrewed from the neck of the container 16, the hooks 31 prevent the band 27 from passing the retaining flange 29 which serves to rupture the frangible bridges 24 connecting the band 27 to the skirt 12.

The hooks 31 have sufficient flexibility to allow the closure 30 to be used in pick and place capping equipment, but also have sufficient stiffness, due to their frusto-conical design, to ensure separation of the band 27 from the skirt 12 during removal of the closure 30 from the container 16.

The frangible bridges 24 in this embodiment are further adapted such that any tampering of the band 27 in an attempt to remove the band 27 by pressing the hooks 31 outwardly against the inner surface 32 of the band 27 will result in the breakage of the bridges 24 thus indicating tamper of the closure 30.

Embodiments of a closure suitable for mounting on a container having an externally screw threaded neck and designed to prevent the problem of missiling are generally shown as 40 in FIGS. 6 to 11. The same reference numbers are adopted for FIGS. 6 to 11 as used in FIGS. 1, 3 and 4 for like items. The embodiments of the closure 40 will only be described in detail insofar as they differ from the description hereinbefore provided.

The closure 40 depicted in FIGS. 6 to 11 is formed with a sealing arrangement which includes a concentric annular rib 13 which extends from the underside of a top 11 of the closure 40. The annular sealing rib 13 includes a first or root portion 14 which extends downwardly from the top 11 approximately concentric with the skirt 12, and a frusto-conical second portion 15 which, prior to engagement with the neck of container 16, tapers inwardly and away from the skirt 12.

Figure 6:
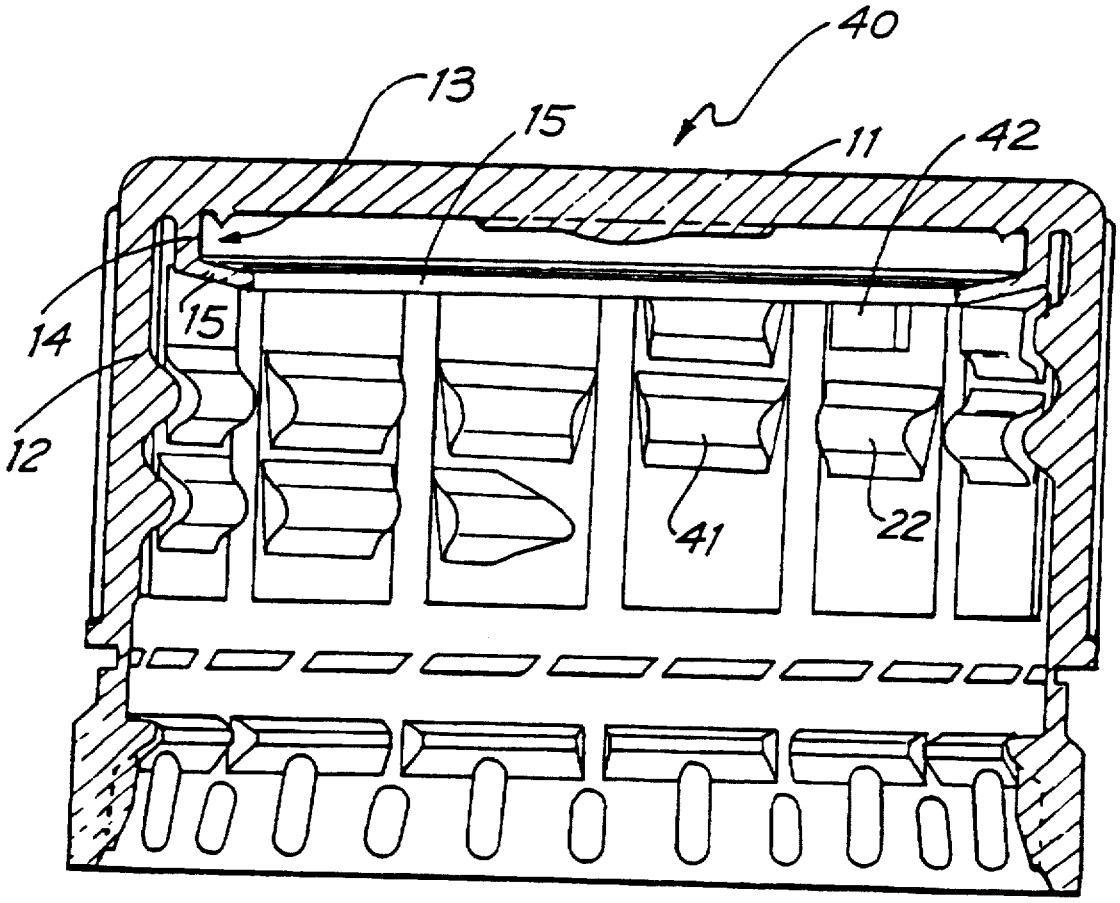
FIG. 6 is a diametric sectional view of an embodiment of the closure according to a further aspect of the present invention showing the anti-missiling abutment in perspective view.
Figure 7:
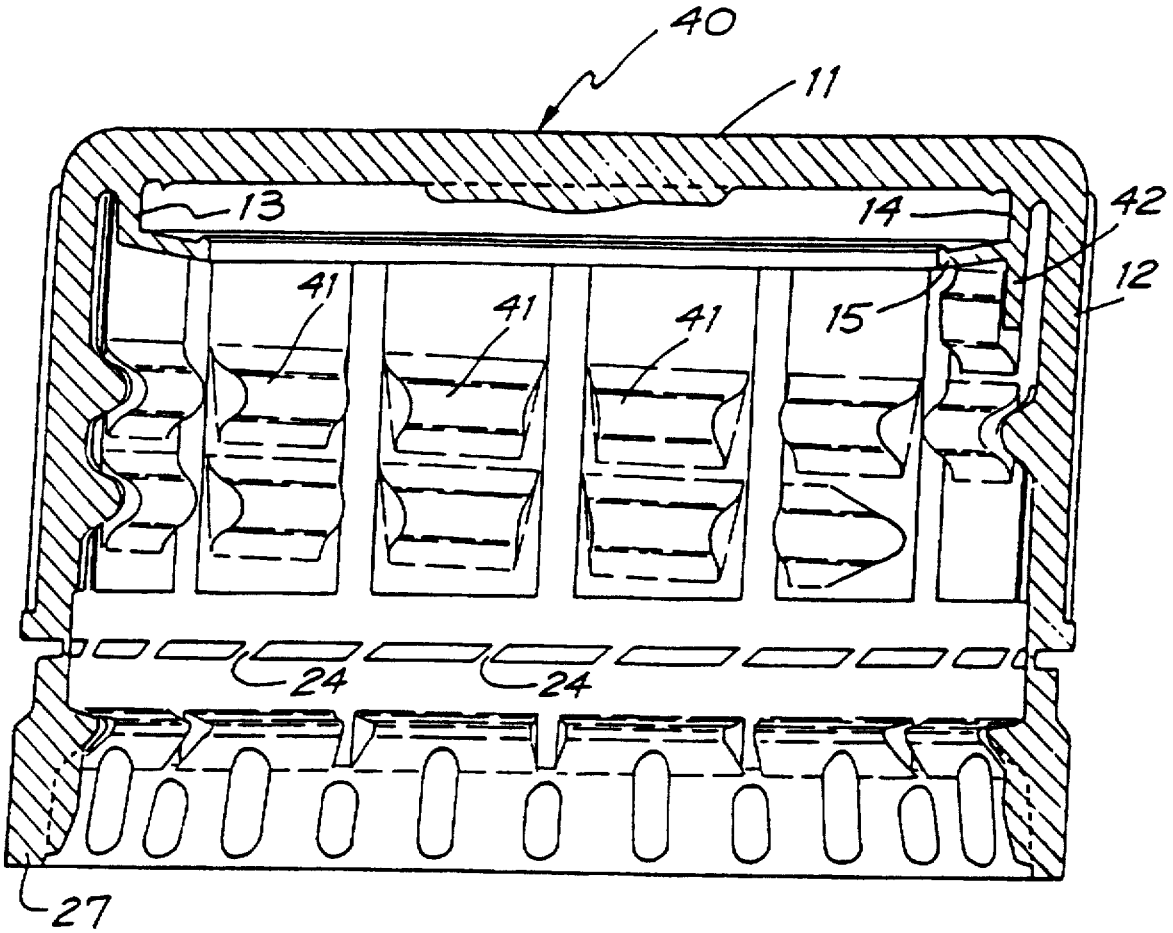
FIG. 7 is a further diametric sectional view of the closure of FIG. 6 but showing the abutment in vertical sectional view.
Figure 8:
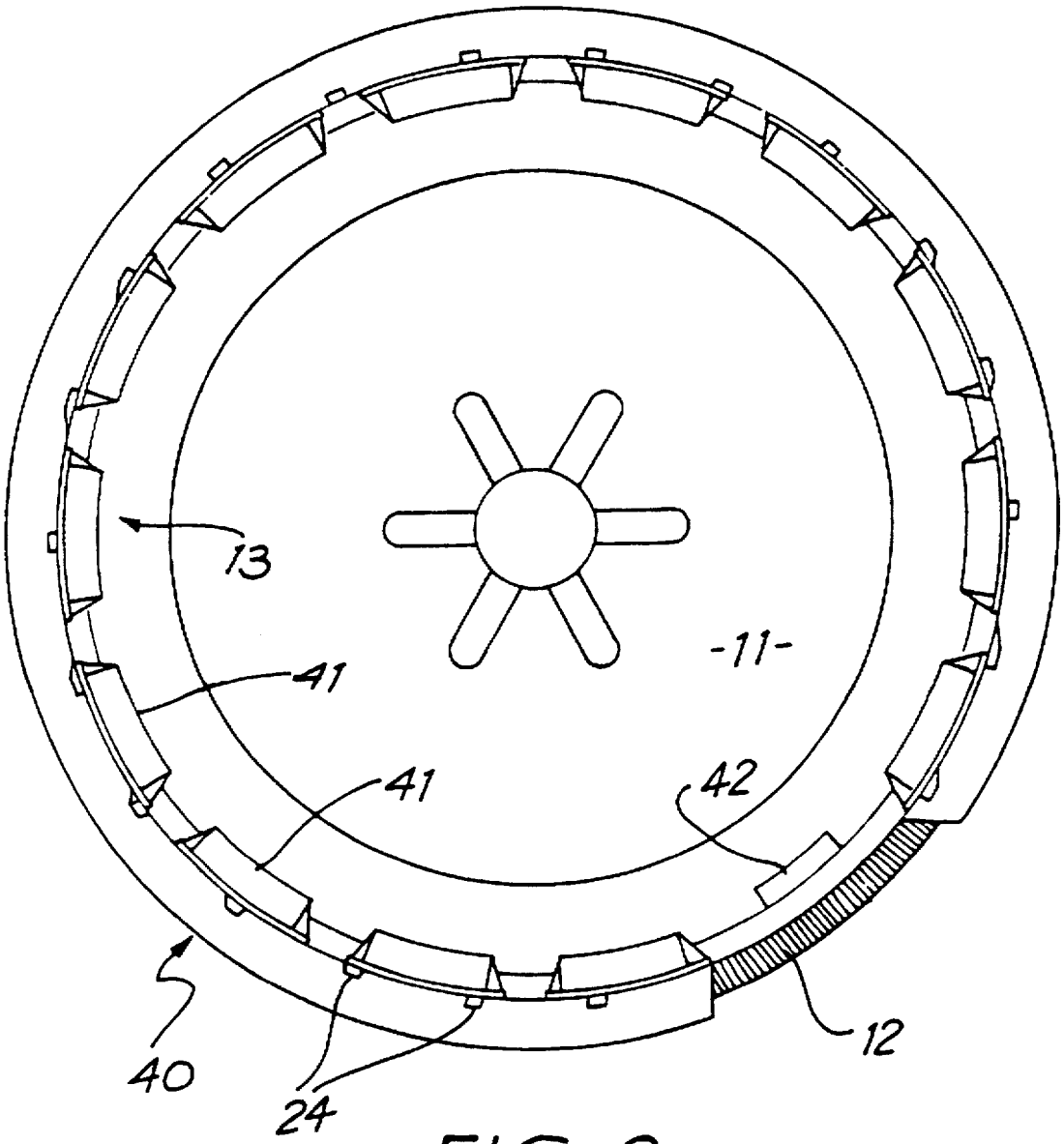
FIG. 8 is a partly cut away horizontal sectional view along VIII—VIII of FIG. 6.

As is best depicted in FIGS. 6 and 7 there is provided on the inner surface of the skirt 12 a thread 22 made up of a plurality of thread segments 41 arranged in spaced apart array along the locus of the thread 22. As is depicted in FIGS. 9 and 10 this thread engages with a corresponding, but continuous, thread 23 on the neck of the container 16.

In order to prevent missiling of the closure 40 depicted in FIGS. 6 to 10 if it is over-torqued, a tab 42 is provided which depends downwardly from the lower edge of and is linearly aligned with the first portion 14 of the sealing rib 13. This tab 42 is about 2 mm long and extends downwardly into the locus of the uppermost turn of the thread 22. In order to accommodate the tab 42 the penultimate thread segment has been removed or at least reduced in height. In the embodiment of the closure 40 depicted in FIG. 11, the tab 42 extends inwardly from the inner surface of the skirt 12. The operation of this embodiment of the closure 40 is identical to that of the closure 40 depicted in FIGS. 6 to 10 described below.

Figure 9:
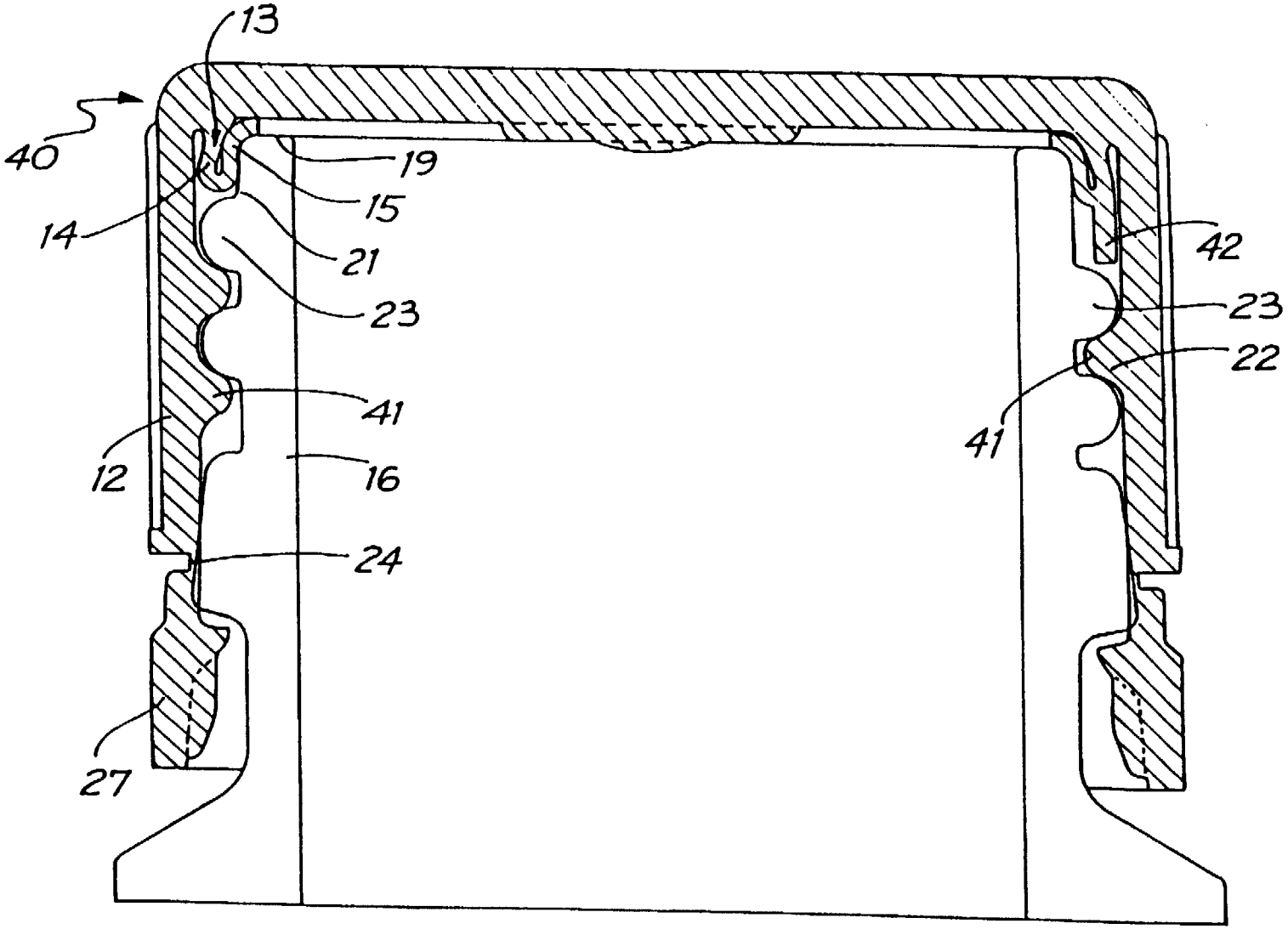
FIG. 9 is a diametric sectional view of the closure of FIG. 6 which has been applied the predetermined amount to a container.
Figure 10:
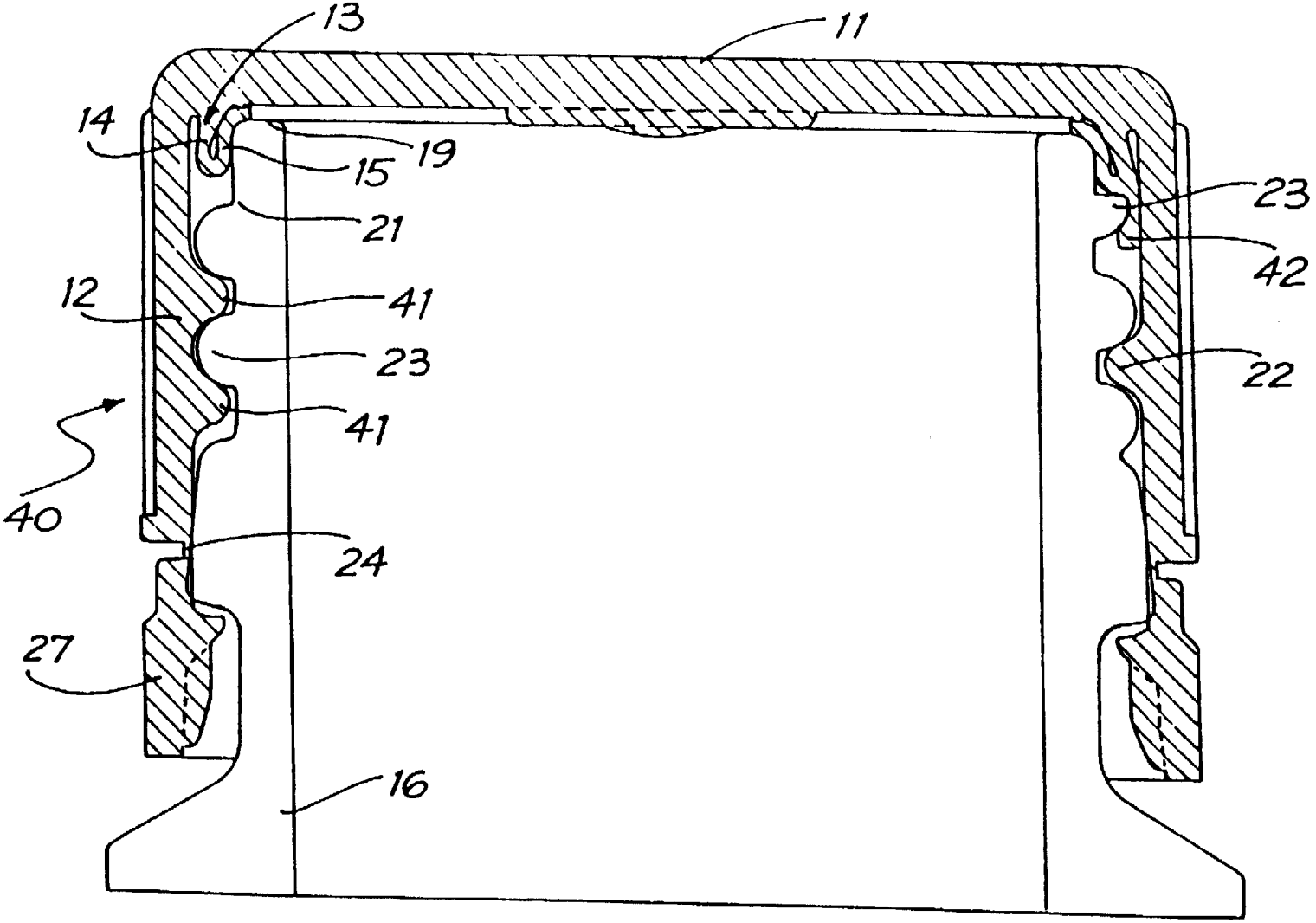
FIG. 10 is a diametric sectional view of the closure of FIG. 6 which has been applied more than the predetermined amount to a closure.
Figure 11:
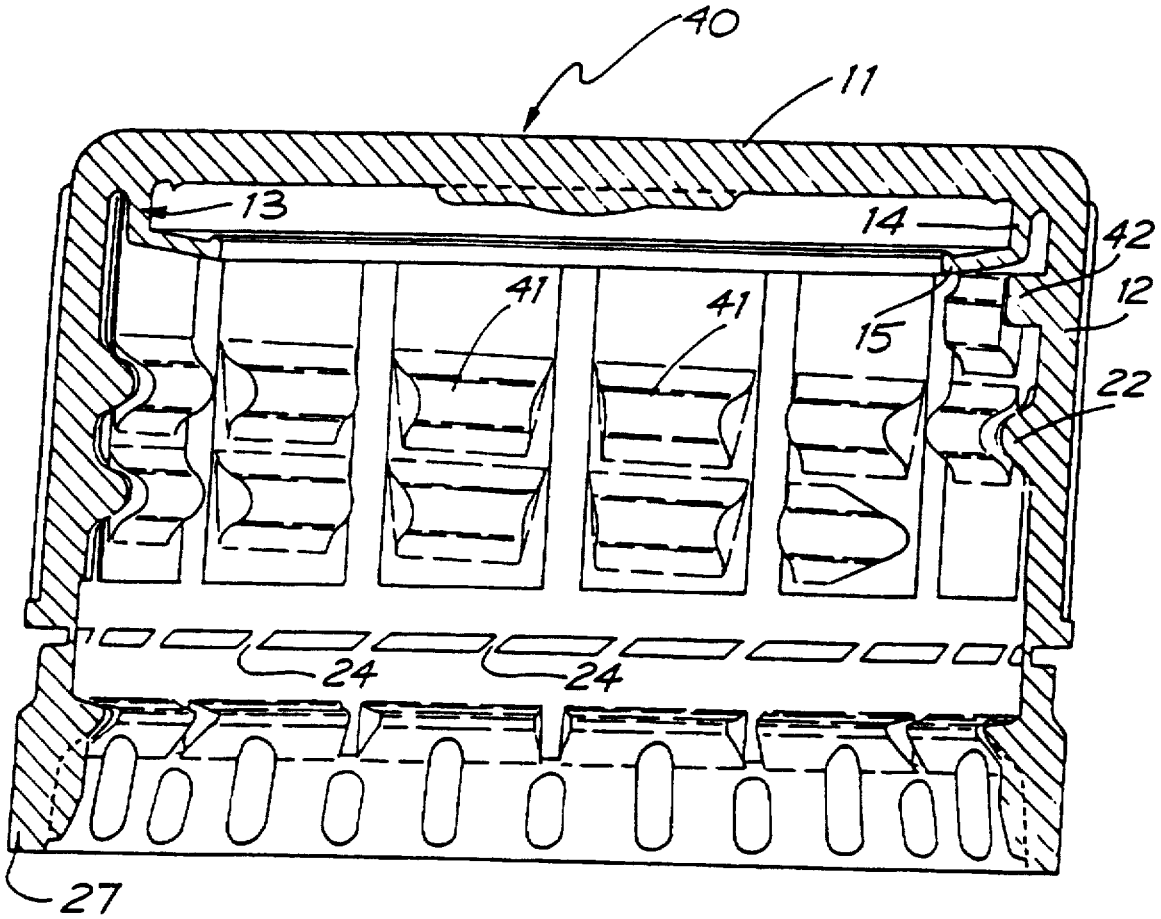
FIG. 11 is a diametric sectional view of another embodiment of a closure according to the further aspect of the present invention showing the abutment in perspective view attached to the skirt of the closure.

As is best depicted in FIG. 9, when the closure 40 is sealingly engaged to the container 16, the second portion 15 of the rib 13 contacts the end 19 of the container 16 and the second portion 15 is caused to fold up against the surface of the first portion 14. Thus there is formed a continuous gas-tight seal between the closure 40 and the container 16 extending up the side wall 21 of the container 16 to its end 19 when the closure 40 has been screwed onto the container 16 a predetermined amount which is indicated by a predetermined torque having been applied to the closure 40.

tab 42 is so placed around the circumference of the sealing rib 13 that, as is seen in FIG. 9, when the closure 40 is applied correctly to the container 16, the tab 42 is not engaged by the thread 23 on the container 16. When the container is over-torqued, as is seen in FIG. 10, the tab 42 is engaged by the leading end of the thread 23 and binds between that thread 23 and the internal surface of the skirt 12 of the closure 40.

The tab 42 has been found to raise the torque necessary to over-rotate the closure 40 relative to the container 16 from about 20 in/lb to in excess of 50 in/lb. This increase in torque necessary to cause the threads to override has the effect of reducing the likelihood of this happening. In addition the closure 40 opposite to tab 42 will tend to lift if over-torquing is achieved thereby lifting the sealing rib 13 off the container 16. The binding of the tab 42 between the container 16 and the skirt 12 will prevent the closure 40 from lifting adjacent the tab 42. This means that rather than closure 40 being projected from container 16 due to its internal pressure, the pressure is vented through the lifted side of the closure 40 without the closure 40 actually being freed from the container 16.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A closure for a neck of a container, the closure being molded from a resilient synthetic plastic material and comprising a top and a skirt depending from an underside of the top, which skirt has an internal surface with a means for attachment with the neck of the container, and an annular sealing rib projecting downwardly from the underside of the top of the closure, the rib including a first portion having a substantially cylindrical inner surface, the first portion being contiguous with the top and lying adjacent to the skirt and a second, frusto-conical, portion contiguous with an end of the first portion distal to the top, having an upper surface, and extending radially inwardly to terminate in a circular free edge, the first portion having an internal diameter suitable for receiving the external diameter of the neck of the container to which the closure is to be attached such that during attachment of the closure with the neck, the second, frusto-conical, portion of the rib will be engaged by a free end of the neck and folded back towards the substantially cylindrical inner surface of the first portion of the rib to form a gas-tight seal between at least an outer surface of the neck of the container and the closure, the closure being characterized in that there is a first annular ridge formed on the upper surface of the second portion of the sealing rib and proximate the free edge of the second portion, a second annular ridge formed on the underside of the top of the closure and positioned inwardly and adjacent the first portion of the annular sealing rib, the first and second annular ridges being so arranged that during attachment of the closure with the neck, the first annular ridge engages with the underside of the top of the closure, the second annular ridge engages with the upper surface of the second portion of the rib adjacent and outside the first annular ridge, and the first and second annular ridges interlock with each other thereby holding the surface of the rib touching the underside the closure stationary and causing the second portion of the sealing rib to be disposed over a greater area of the underside of the top as well as the outer surface of the neck of the container.

2. The closure as defined in claim 1, wherein the attachment means comprises a screw thread on the radially inner surface of the skirt arranged to engage with a complementary screw thread on the neck of the container.

3. The closure as defined in claim 2 wherein the thread on the internal surface of the skirt is formed of a series of thread segments arranged, starting from a first thread segment, distal to the top, along a helical thread locus, each of the thread segments, except the first, being formed with two substantially planar end surfaces which are inclined to the axis of the closure and face away from the closure top, the first of the thread segments being pointed at its end distal to its one adjacent thread segment to assist in mating the thread on the closure with the complementary thread on the neck of the container.

4. The closure as defined in claim 1 wherein the skirt of the closure has a free edge joined by a plurality of frangible bridges to a tamper evident band having a radially inner surface, and wherein the skirt is substantially cylindrical, has a radially inner and outer surface, and carries on its outside surface a series of fine vertical ribs terminating at the free edge of the skirt in a narrow circumferential rib;

the frangible bridges being considerably thinner in their radial dimensions than the skirt and each having an inner surface lying flush with the respective radially inner surfaces of the skirt and the band; and the radially outer surface of the band being of a slightly smaller diameter than the skirt except in areas of local thickening which project radially outwardly beyond the radial extent of the skirt.

5. The closure as defined in claim 1 wherein the skirt of the closure has a free edge joined by a plurality of frangible bridges to a tamper evident band having a lower end, and wherein the skirt has a generally cylindrical inside surface with a helical array of thread segments projecting radially inwardly of that surface, the thread segments being separated from one another by axially aligned spaces; the inside of the band being defined by a smooth upper cylindrical surface above a rib, the upper cylindrical surface being of the same diameter as the inside surface skirt;

the rib being formed of rib segments arranged about the inside circumference of the band, the rib segments being separated from one another by axially aligned spaces, the rib segments being in axial alignment with the thread segments on the inside surface of the skirt and with the spaces between the rib segments in axial alignment with the spaces between the thread segments; and the inside surface of the band below the rib being inclined downwardly and outwardly so that the band is a little thinner at its lower end than at its upper end, this surface carrying an array of projections which are axially aligned and of a radial thickness less than that of the rib segments, alternate projections being spaced below breaks between adjacent rib segments and further not connected to the rib, the remaining inwardly extending projections being connected substantially at the center of the rib segments.

6. The closure as defined in claim 1 in which the closure is formed by injection molding from a synthetic plastic material in a mold which defines the first annular ridge on the upper surface of the second portion of the sealing rib and which defines the underside of the closure as provided with a second annular ridge positioned inwardly and adjacent the first portion of the annular sealing rib.

7. The closure as defined in claim 1, wherein the second frusto-conical portion of the rib is of a thickness tapering from a maximum thickness proximal the end of the first portion to a minimum thickness at its circular free edge, the first portion and second frusto-conical portion joining at an included angle of at least 900°.

8. The closure as defined in claim 1 wherein the skirt of the closure has a free edge joined by a plurality of frangible bridges to a tamper evident band, the band comprising a generally cylindrical body portion and a segmented rib extending inwardly of the body portion and arranged to provide a lip to engage under a retaining flange extending outwardly from the neck of the container below the attachment means, the engaging rib having an upper side facing generally towards the top of the closure and an underside facing generally away from the top, the body portion being provided with projections or other localized areas of thickening to enhance the longitudinal stiffness of the body portion while still permitting it to expand radially as it is forced over the retaining flange on the container.

9. The closure as defined in claim 8 wherein the upper side of the engaging rib comprises a first surface contiguous with the body portion of the band, which surface slopes inwardly and downwardly from the top, and a second surface which is positioned radially inwardly from the first surface, the second surface having a slope angle more nearly normal to the longitudinal axis of the closure than the first surface is to that longitudinal axis.

10. The closure as defined in claim 9 wherein the inner surface of the band is provided with an array of radially spaced apart inwardly extending projections disposed between the rib and a free edge of the band.

11. The closure as defined in claim 10 wherein the projections are aligned parallel with the longitudinal axis of the closure and alternate projections are spaced below breaks between adjacent portions of the rib and are further not connected to the rib, the remaining inwardly extending projections being connected substantially at the center of the rib portions.

12. The closure as defined in claim 1 wherein the skirt of the closure has a free edge joined by a plurality of frangible bridges to a tamper evident band, the band comprising a generally cylindrical body portion and a series of hooks, each hook comprising a frusto-conical portion hingably connected to an inner surface of the body portion adjacent an end of the body portion distal the skirt of the closure, each frusto-conical portion extending inwardly and upwardly to terminate in a free edge, each frusto-conical portion having a curvature substantially identical to a curvature of the inner surface of the body portion and being nestable against the inner surface of the body portion whereby on attachment to the container, the free edge of the frusto-conical portion engages under a retaining flange on the container with the frusto-conical portion proximate the hinge coincident with the inner wall of the body portion such that the free edge of the frusto-conical portion is not exposed to tamper.

13. A closure for a container having a neck, comprising a top and a skirt depending from an underside of the top, the skirt having an internal surface with a means for attachment with the neck of the container, and an annular sealing rib projecting downwardly from the underside of the top of the closure, the rib including a first portion having a substantially cylindrical inner surface, the first portion being contiguous with the top and lying adjacent to the skirt and a second, frusto-conical, portion contiguous with an end of the first portion distal to the top, having an upper surface, and extending radially inwardly to terminate in a circular free edge, the first portion having an internal diameter suitable for receiving the external diameter of the neck of the container to which the closure is to be attached such that during attachment of the closure with the neck, the second, frusto-conical, portion of the rib is engaged by a free end of the neck and folded back towards the substantially cylindrical inner surface of the first portion of the rib to form a gas-tight seal between at least an outer surface of the neck of the container and the closure, the closure being characterized in that there is formed on the upper surface of the second portion of the rib and proximate its free edge, engagement means so arranged that during attachment of the closure with the neck, the engagement means engages with the underside of the top, and wherein a free edge of the skirt is joined by a plurality of frangible bridges to a tamper evident band and wherein an inside surface of the skirt is generally cylindrical with a helical array of thread segments projecting radially inwardly of that surface, the thread segments being separated from one another by axially aligned spaces; the inside of the band being defined by a smooth upper cylindrical surface above a rib, the upper cylindrical surface being of the same diameter as the inside surface of the skirt;

the rib being formed of rib segments arranged about the inside circumference of the band in axial alignment with the thread segments on the inside surface of the skirt and with the spaces between the rib segments in axial alignment with the spaces between the thread segments; and an inside surface of the band below the rib being inclined downwardly and outwardly so that the band is thinner at its lower end than at its upper end, this surface carrying an array of projections axially aligned and of a radial thickness less than that of the rib segments, alternate projections being spaced below breaks between adjacent rib segments and further not connected to the rib, the remaining inwardly extending projections being connected substantially at the center of the rib segments.

* * * * *